US011812822B2

(12) United States Patent
Yu et al.

(10) Patent No.: US 11,812,822 B2
(45) **Date of Patent: *Nov. 14, 2023**

(54) SIZE-ADJUSTABLE SPORT SHOE

(71) Applicant: TRI GOLD MANUFACTURE CO., LTD, Guangzhou (CN)

(72) Inventors: Ting-Hung Yu, Guangzhou (CN); Chuan-Hung Yu, Guangzhou (CN)

(73) Assignee: TRI GOLD MANUFACTURE CO., LTD., Guangdong (CN)

( * ) Notice: Subject to any disclaimer, the term of this patent is extended or adjusted under 35 U.S.C. 154(b) by 375 days.

This patent is subject to a terminal disclaimer.

(21) Appl. No.: 17/140,520

(22) Filed: Jan. 4, 2021

(65) Prior Publication Data

US 2021/0121766 A1 Apr. 29, 2021

Related U.S. Application Data

(63) Continuation of application No. 14/436,872, filed on Mar. 22, 2016, now Pat. No. 11,376,485.

(51) Int. Cl.

| | |
|---|---|
| ***A43B 5/16*** | (2006.01) |
| ***A43B 3/26*** | (2006.01) |
| ***A43B 5/00*** | (2022.01) |
| ***A43B 17/16*** | (2006.01) |

(52) U.S. Cl.

CPC ..... *A43B 5/1608* (2013.01); *A43B 3/26* (2013.01); *A43B 5/00* (2013.01); *A43B 17/16* (2013.01)

(58) Field of Classification Search

CPC ..... A43B 5/1608; A43B 5/00; A43B 3/26; A43B 17/16; A63C 1/26; A63C 17/0086

See application file for complete search history.

(56) References Cited

U.S. PATENT DOCUMENTS

| | | | | |
|---|---|---|---|---|
| 4,262,918 | A * | 4/1981 | Sandino | A63C 17/02 280/11.26 |
| 4,684,140 | A * | 8/1987 | Olivieri | A63C 17/0086 280/11.26 |
| 4,708,352 | A * | 11/1987 | Vullierme | A63C 17/02 280/11.26 |
| 5,437,110 | A * | 8/1995 | Goldston | A43B 21/30 36/38 |
| 5,484,149 | A * | 1/1996 | Lee | A63C 17/0086 280/11.26 |
| 5,620,190 | A * | 4/1997 | Maggiore | A63C 17/1454 280/11.26 |
| 6,247,707 | B1 * | 6/2001 | Conte | A43B 5/1608 280/11.26 |
| 6,276,697 | B1 * | 8/2001 | Lin | A63C 17/06 280/11.26 |
| 6,438,872 | B1 * | 8/2002 | Chil | A43B 3/26 36/97 |

(Continued)

*Primary Examiner* — Bao-Thieu L Nguyen
(74) *Attorney, Agent, or Firm* — Raymond Y. Chan; David and Raymond Patent Firm

(57) ABSTRACT

A size-adjustable sport shoe includes a shoe head, a shoe insole, and an adjusting telescopic device including a gear, a shaft gear, first and second gear racks, and handle. The first and second gear racks are located at two lateral sides of an elongated adjustment groove at the shoe head, wherein the upper surface of the second gear rack is lower than the upper surface of the first gear rack. The gear shaft is coupled between the gear and the handle. When the handle is folded perpendicularly to an axis direction of the gear shaft, the gear meshes with the first gear rack to lock up the shoe head at the shoe insole. When the handle is folded to coincide with the axis direction of the gear shaft, the gear meshes with the second gear rack to allow the shoe head to be slid from the shoe insole.

20 Claims, 4 Drawing Sheets

(56) References Cited

U.S. PATENT DOCUMENTS

| | | | | |
|---|---|---|---|---|
| 6,450,510 | B1 * | 9/2002 | Liu | A63C 17/06 280/11.26 |
| 6,497,421 | B1 * | 12/2002 | Edgerley | A63C 1/26 280/11.26 |
| 6,517,091 | B1 * | 2/2003 | Fisher | A63C 1/26 280/11.26 |
| 6,766,597 | B1 * | 7/2004 | Perrod | A43B 3/26 36/97 |
| 6,786,493 | B2 * | 9/2004 | Hong | A63C 17/0086 280/11.26 |
| 7,144,018 | B1 * | 12/2006 | Chen | A63C 17/0086 280/11.26 |
| 11,376,485 | B2 * | 7/2022 | Yu | A43B 5/00 |
| 2003/0141679 | A1 * | 7/2003 | Hong | A63C 17/0086 280/11.26 |
| 2004/0094917 | A1 * | 5/2004 | Frigo | A63C 17/0086 280/11.31 |
| 2004/0217562 | A1 * | 11/2004 | Haugen | A63C 17/06 280/11.221 |
| 2005/0057008 | A1 * | 3/2005 | Yiu Lu | A63C 17/06 280/11.26 |
| 2005/0151331 | A1 * | 7/2005 | Chen | A43B 5/1608 280/11.26 |
| 2010/0230914 | A1 * | 9/2010 | Chen | A63C 17/04 280/7.1 |
| 2011/0193303 | A1 * | 8/2011 | Green | A63C 17/04 280/11.26 |
| 2012/0187648 | A1 * | 7/2012 | Chen | A63C 17/0033 280/87.042 |
| 2018/0185740 | A1 * | 7/2018 | De Minicis | A63C 17/0086 |

* cited by examiner

SIZE-ADJUSTABLE SPORT SHOE

CROSS REFERENCE OF RELATED APPLICATION

This application is a Continuation application that claims the benefit of priority under 35U.S.C. § 120 to a non-provisional application, application Ser. No. 14/436,872, filed Mar. 22, 2016, which is a non-provisional application U.S. National Stage under 35 U.S.C. 371 of the International Application Number PCT/CN2012/085012, international filing date Nov. 22, 2012, which are incorporated herewith by references in their entirety.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights what sever.

BACKGROUND OF THE PRESENT INVENTION

Field of Invention

The present invention relates to a shoe, and more particular to a size-adjustable shoe, wherein the wearer is able to quickly and simply adjust the size of the shoe by sliding the shoe head with respect to the shoe insole.

Description of Related Arts

Due to raise awareness of environmental issues, most people have changed their lifestyles especially for the consumption concept. Wearers nowadays look for a pair of sport shoes which can adjust the size thereof via an adjustment means to be suitable for different sizes of feet. Accordingly, our feet fluctuate in size. For example, the feet would be slightly bigger in hot weather and would be slightly smaller in cold weather. The sizes of the feet are different at different stages of the wearer such as different body sizes (fat or slim) of the wearer. Sometimes, two different wearers may share a pair of shoes. However, the conventional shoe cannot adjust its size. Therefore, the size-adjustable shoes, especially for the expensive sport shoes, are highly demanded.

Accordingly, the conventional size-adjustable shoe in the existing market can change its size by moving the heel back and forth to adjust the length of the shoe. However, it is not ergonomic that two lateral portions of the shoe are not connected properly, such that the function and the useful of the shoe will be significantly reduced. The movement of the heel is guided by a heel adjustment mechanism provided at a heel portion of the shoe insole at the bottom side thereof Therefore, the heel adjustment mechanism can be easily damaged by any external force and/or the weight force of the wearer directly applied to the heel of the shoe. In other words, the size of the shoe should not be adjusted via the heel through the heel adjustment mechanism. Another type of size-adjustable shoe incorporates with a movable head portion to slidably couple with the shoe insole. However, the major drawback of such size-adjustable shoe is that the head portion must be affixed to the shoe insole via fastener, such as screws and nuts. Therefore, the wearer must use a tool to unscrew the fastener to adjust the size of the shoe and to screw the fastener back to retain the size of the shoe. It is inconvenient for the wearer to change the size during outdoor activities. When missing the fastener, the shoe cannot be changed its size. More seriously, the shoe cannot be worn any more.

China utility model Patent No. CN 201403584 disclosed a size-adjustable shoe to solve the above mentioned problems. The shoe comprises a shoe insole, a shoe head, and sliding mechanism to enable the shoe head to slidably couple with the shoe insole via a holding spring force in order to adjust a length of the shoe. Accordingly, the sliding mechanism comprises a rectangular shaped slot formed at a bottom side of the shoe head to define two lateral gear racks, two gear holes formed at the shoe insole, and two gears coupled at the gear holes to engage with the gear racks respectively. Therefore, the gears are moved along the gear racks to move the shoe head from the shoe insole so as to adjust the length of the shoe. However, the shoe has three major drawbacks. Firstly, it needs great effort for the wearer to put down a handle to overcome the holding spring force for unlocking the sliding mechanism so as to adjust the length of the shoe. In other words, the wearer, such as a child or a person who has a smaller hand, is hard to hold and pull the handle at the same time to adjust the length of the shoe. Secondly, there is no toe cover formed at the shoe head, such that the wearer may easily get tripped by the extension of the upper layer of the shoe insole when the length of the shoe is shortened. Lastly, the sliding mechanism is not designed for a smaller shoe since the extension of the upper layer of the shoe insole will affect the use of the shoe and will affect the aesthetic appearance of the shoe.

SUMMARY OF THE PRESENT INVENTION

The invention is advantageous in that it provides a size-adjustable shoe, wherein the shoe structure can be selectively adjusted its size according to the foot-size of the wearer. Therefore, the size-adjustable shoe provides a quick adjusting access, a safe sport equipment, and an aesthetic appearance of the shoe.

Additional advantages and features of the invention will become apparent from the description which follows and may be realized by means of the instrumentalities and combinations particular point out in the appended claims.

According to the present invention, the foregoing and other objects and advantages are attained by a size-adjustable sport shoe, comprising a shoe head, a shoe insole, and an adjusting telescopic device for enabling the shoe head to slide back and forth along the shoe insole. The adjusting telescope device comprises a gear, a shaft gear, a first gear rack, a second gear rack, handle, a resilient device, and a sleeve. The first gear rack and the second gear rack are parallelly provided along two lateral sides of an elongated adjustment groove at the bottom of the shoe head, wherein an upper surface of the second gear rack is higher than an upper surface of the first gear rack. One end of the gear shaft is coupled at the gear and an opposed end of the gear shaft is coupled at the handle. The elastic device sheathes on the gear shaft between the gear and the handle, and the sleeve sheathes outside the gear shaft. When the handle is folded to be perpendicular to an axis direction of the gear shaft, the gear meshes with the first gear rack. When the handle is folded to coincide with the axis direction of the gear shaft, the gear meshes with the second gear rack.

Another advantage of the invention is to a size-adjustable shoe, wherein the shoe cover will cover the extension of the shoe insole when the length of the shoe is selectively reduced.

Accordingly, the adjustment slot is formed at an inner bottom side of the shoe head to communicate with a bottom of thereof.

Preferably, the handle has a U-shaped configuration.

Accordingly, an ice skating assembly or a roller blade assembly can be affixed to the bottom of the shoe to form a sport shoe.

According to the preferred embodiment, a retention panel is embedded into the shoe head to form a one piece integrated shoe structure, wherein the adjustment slot is formed at the retention panel.

According to the preferred embodiment, the adjustment slot can be a rectangular shape with curved front and rear ends or a rectangular shape with flat front and rear ends.

According to the preferred embodiment, the handle has a positioning slot, and the shoe insole further has two or more positioning members, wherein the positioning slot is selectively engaged with one of the positioning members.

According to the preferred embodiment, the shoe head has a dovetail shaped wedged member and the shoe insole has a dovetail shaped wedged slot, wherein the wedged member is slidably engaged with the wedged slot.

According to the preferred embodiment, the shoe insole has a guiding channel and the shoe head has a sliding guider slidably engaged with the guiding channel. The shoe head further has at least an elongated retention slot and the shoe insole further comprises at least a retention member slidably engaged with the retention slot.

Through the adjusting telescopic device of present invention, the handle can be lifted without any great effect, the adjusting telescopic device can bounce back automatically so as to achieve the quick size adjustment of the shoe. Also, the shoe cover will cover the extension of the shoe insole for preventing the wearer from being tripped and for enhancing the aesthetic appearance of the shoe.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 7:
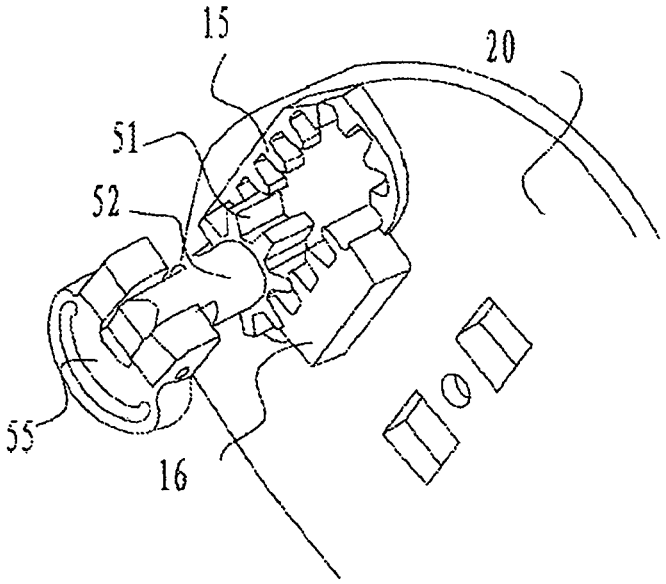
FIG. 7 is a perspective view of the gear mechanism of the adjusting telescopic device of the size-adjustable shoe according to the above preferred embodiment of the present invention.
Figure 8:
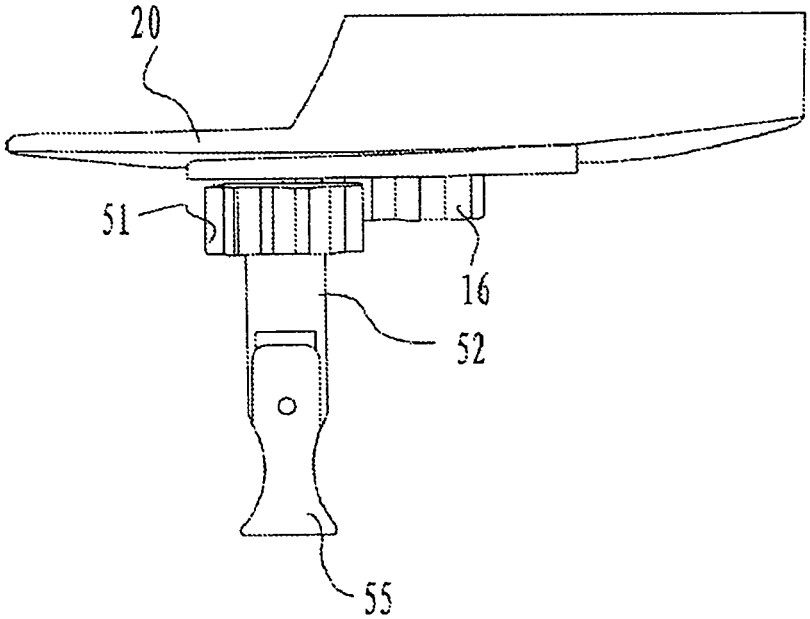
FIG. 8 is a side view of the gear mechanism of the adjusting telescopic device of the size-adjustable shoe according to the above preferred embodiment of the present invention.
Figure 9:
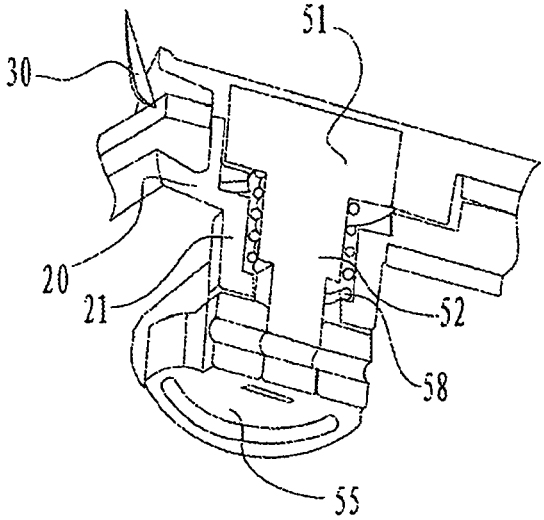
FIG. 9 is a partially perspective view of the adjusting telescopic device of the size-adjustable shoe according to the above preferred embodiment of the present invention.

Referring to FIGS. 1-5 and 7-9 of the drawings, a size-adjustable shoe according to a preferred embodiment of the present invention is illustrated, wherein the size-adjustable shoe comprises a shoe head 10, a shoe insole 20, and an adjusting telescope device for slidably coupling the shoe head 10 with the shoe insole 20 to enable the shoe head 10 to slide back and forth with respect to the shoe insole 20. Accordingly, the adjusting telescope device comprises an engaging element embodied as a gear 51, an adjusting element embodied as a shaft gear 52, a first rack embodied as gear rack 15, a second rack embodied as gear rack 16, a handle 55, a resilient device 58, and a sleeve 21. The shoe head 10 has an elongated adjustment slot 12 formed at an inner bottom side of the shoe head 10, wherein the first gear rack 15 and the second gear rack 16 are located at the adjustment slot 12 at two lateral sides thereof respectively, such that the first gear rack 15 and the second gear rack 16 are parallel with each other at the lateral sides of the adjustment slot 12. Accordingly, the first gear rack 15 and the second gear rack 16 are supported at different horizontal levels. In particular, an upper surface of the second gear rack 16 is lower than an upper surface of the first gear rack 15. Preferably, the first gear rack 15 is integrated with one of the lateral side of the adjustment slot 12 while the second gear rack 16 is located under the opposed lateral side of the adjustment slot 12. One end of the gear shaft 52 is meshed with the gear 51 and an opposed end of the gear shaft 52 is pivotally connected and hinged with the handle 55, wherein the handle 55 at the bottom of the shoe head 10 is actuated to selectively engage the gear 51 with one of the first gear rack 15 and the second gear rack 16. The resilient device 58, such as a compression spring, is coaxially sheathed on the gear shaft 52 at a position between the gear 51 and the handle 55 for applying a resilient force therebetween. The sleeve 21 sheathes outside the gear shaft 52. Accordingly, when the handle 55 is pivotally folded to perpendicular to an axis direction of the gear shaft 52, as shown in FIG. 7, the gear 51 meshes with the first gear rack 15 only to prevent the sliding movement of the shoe head 10 from the shoe insole 20. At the same time, the handle 55 is spacedly located with respect to the sleeve 21 with a predetermined distance, such that the resilient device 58 is maintained in an uncompressed condition. When the handle 55 is pivotally folded to coincide and align with the axis direction of the gear shaft 52, as shown in FIG. 8, the handle 55 is moved to bias against the sleeve 21 to compress the resilient device 58. Through the resilient force of the resilient device 58, the gear 51 is driven downwardly by the handle 55 to mesh with the second gear rack 16 and to disengage with the first gear rack 15 to allow the shoe head 10 to be slid from the shoe insole 20. In other words, the wearer is able to s electively adjust the size of the shoe via the actuation of the handle 55.

According to the preferred embodiment, the shoe head 10 further comprises an upper shoe cover 30 to cover an extension of the shoe insole 20. When the length of the shoe is selectively reduced, the extra extension of the shoe insole 20 will protrude from the shoe, such that the wearer is easily get tripped. The shoe cover 30 will cover the extension of the shoe insole 20 when the length of the shoe is selectively reduced for safety purpose and for maintaining the aesthetic appearance of the shoe.

Accordingly, the shoe of the present invention can serve as an ice skating shoe or a roller blade shoe. The ice skate assembly can be mounted at the bottom side of the shoe. Likewise, an inline skate assembly or a roller blade assembly can be mounted at the bottom of the shoe. Therefore, the shoe of the present invention forms a sport shoe, especially for the expensive shoe, to allow the wearer to selectively adjust the size of the shoe, such that the shoe of the present invention serves as an environmentally friendly product.

According to the preferred embodiment, the shoe head 10 of the present invention, which is an embedded type shoe head, comprises a retention panel embedded into the shoe head 10, wherein the adjustment slot 12 is a through slot formed on the retention plane. Accordingly, the shoe head 10 is made of soft and comfort material, such as plastic, wherein the retention panel is made of rigid material to configure the adjustment slot 12 thereon. In other words, the adjustment slot 12 is formed at the retention panel to retain the shape of the adjustment slot 12 to ensure the size-adjustment of the shoe.

Preferably, the adjustment slot 12 can be a rectangular shape with curved front and rear ends or a rectangular shape with flat front and rear ends. During the sliding movement of the shoe head 10, the gear 51 is located within the adjustment slot 12. In particular, the two lateral sides of the adjustment slot 12 will restrict any unwanted lateral movement of the gear 51, such that the shoe head 10 can only slide along the length direction of the adjustment slot 12.

According to the preferred embodiment, the handle 55 has a positioning slot 56, wherein the shoe insole 20 further has two or more positioning members 56 spacedly formed at the bottom of the shoe insole 20. The handle 55 is folded flat on the bottom of the shoe insole 20, such that the positioning slot 56 is selectively engaged with one of the positioning members 56 to lock up the shoe head 10 with the shoe insole 20 so as to prevent the shoe head 10 being slid from the shoe insole 20.

Preferably, there are four positioning members 56 spacedly formed at the shoe insole 20 to provide four different sizes of the shoe. In other words, when the positioning slot 56 is engaged with the first positioning member 56, the shoe is adjusted and locked up at the smallest size thereof. When the positioning slot 56 is engaged with the fourth positioning member 56, the shoe is adjusted and locked up at the largest size thereof. Therefore, the shoe of the present invention is suitable for different foot sizes of the wearer, especially for a child's foot that grows faster.

Accordingly, the shoe head 10 has a dovetail shaped wedged member and the shoe insole 20 has a dovetail shaped wedged slot, wherein the wedged member is slidably engaged with the wedged slot to guide the shoe head 10 to slide at the shoe insole 20, so as to adjust the size of the shoe. Accordingly, the wedged member and the wedged slot has the corresponding dovetail shaped cross section.

Figure 1:
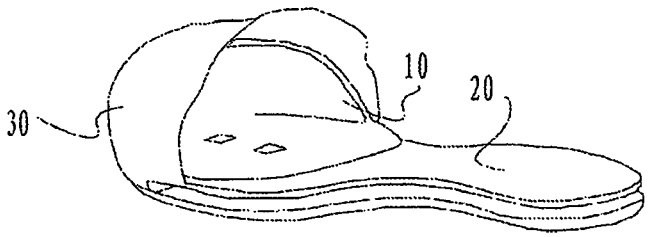
FIG. 1 is perspective view of a size-adjustable shoe according to a preferred embodiment of the present invention, illustrating the size-adjusting shoe with a shoe cover.
Figure 2:
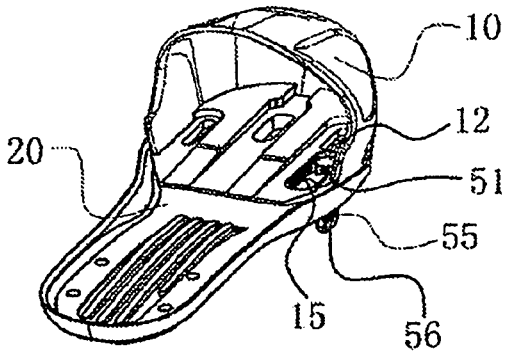
FIG. 2 is a perspective view of the size-adjustable shoe according to the above preferred embodiment of the present invention, illustrating the size-adjusting shoe without a shoe cover.
Figure 3:
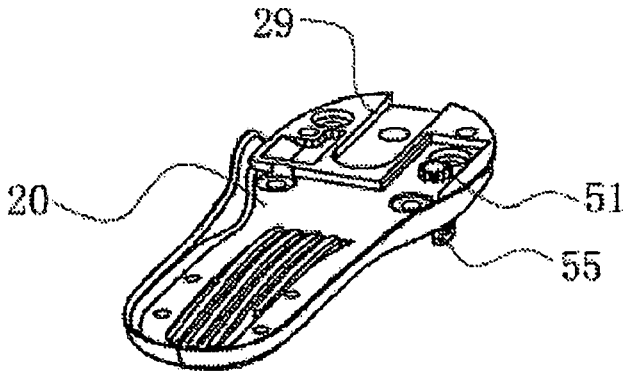
FIG. 3 is a perspective view of an adjusting telescopic device of the size-adjustable shoe according to the above preferred embodiment of the present invention.
Figure 4:
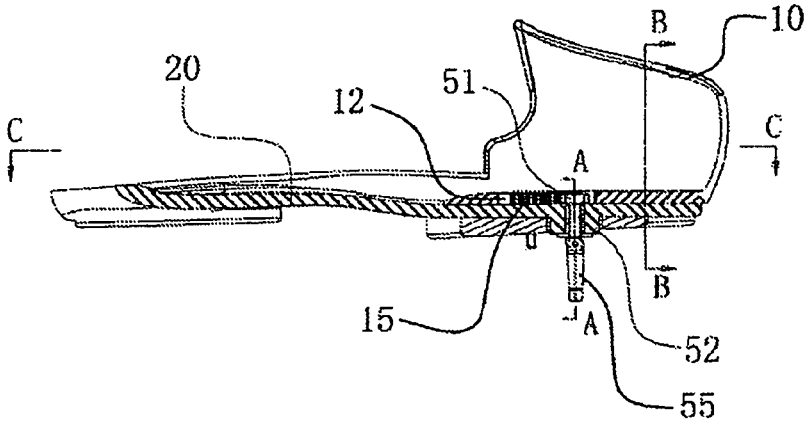
FIG. 4 is a sectional view of the adjusting telescopic device of the size-adjustable shoe according to the above preferred embodiment of the present invention.
Figure 5:
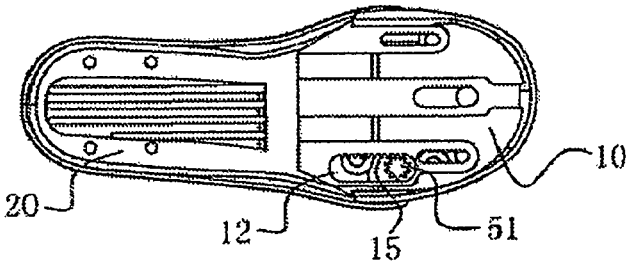
FIG. 5 is a top view of the adjusting telescopic device of the size-adjustable shoe according to the above preferred embodiment of the present invention.
Figure 6:
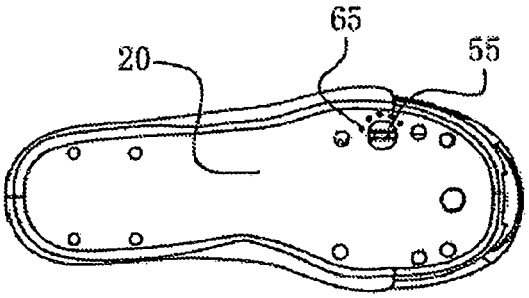
FIG. 6 is a bottom view of the adjusting telescopic device of the size-adjustable shoe according to the above preferred embodiment of the present invention.
Figure 10:
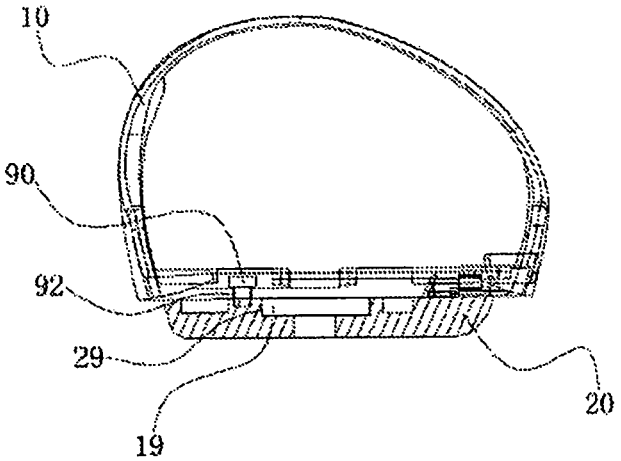
FIG. 10 is a sectional view of the adjusting telescopic device of the size-adjustable shoe according to the above preferred embodiment of the present invention, illustrating the sliding mechanism of the adjusting telescopic device.

In particular, as shown in FIGS. 3 and 10, the shoe insole 20 has a guiding channel 29 formed at the inner bottom side of the shoe head 10 at a mid-portion thereof and adjacent to the adjustment slot 12, wherein the shoe head 10 has a sliding guider 19 downwardly protruded from the bottom side to slidably engage with the guiding channel 29 so as to guide the shoe head 10 to slide at the shoe insole 20. The shoe head 10 further has at least an elongated retention slot 92 formed at the bottom side thereof and the shoe insole further comprises at least a retention member 90 upwardly extended therefrom and having an enlarged head portion slidably engage with the retention slot 92. Through the engagement between the sliding guider 19 and the guiding channel. 29 and the engagement between the retention member 90 and the retention slot 92, the sliding movement of the shoe head 10 will be restricted along the length direction of the shoe, so as to prevent any unwanted lateral movement of the shoe head 10 with respect to the shoe insole 20. In particular, through the engagement between the retention member 90 and the retention slot 92, the shoe head 10 cannot be entirely detached from the shoe insole 20, and the head portion of the shoe head 10 cannot be bent upwardly. As a result, the shoe head 10 can only slide along the guiding channel 29 by the rotational movement of the gear shaft 52 to adjust the size of the shoe. For enhancing the stable movement of the shoe to prevent the lateral movement of the shoe head 10, two retention slots 92 can be spacedly and parallelly formed at the shoe head 10 to slidably engage with two retention members 90 at the shoe insole 20.

As shown in FIGS. 7 and 8, in order to selectively adjust the size of the shoe of the present invention, the wearer is able to pivotally fold the handle 55 to disengage the positioning slot 56 from the corresponding positioning member 65, such that the shoe head 10 can be selectively slid with respect to the shoe insole 20. It is worth mentioning that the wearer does not need to rotate the handle 55 or detach any fastener for size adjustment of the shoe. Therefore, the wearer is able to adjust the size of the shoe anywhere especially during outdoor activities. Once the size of the shoe is adjusted, the wearer is able to pivotally fold the handle 55 back to engage the positioning slot 56 with another positioning member 65. It is worth mentioning that the adjusting telescope device is embedded into the shoe to minimize the manufacturing cost of the shoe and to enhance the quality of the shoe.

One skilled in the art will understand that the embodiment of the present invention as shown in the drawings and described above is exemplary only and not 5 intended to be limiting. It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A size-adjustable shoe, comprising:

a shoe head having an elongated adjustment slot formed at an inner bottom side defining two lateral sides;

a shoe insole coupled with said shoe head; and an adjusting telescopic device slidably coupled with said shoe head and with said shoe insole, wherein said adjusting telescopic device comprises:

a first rack and a second rack located along said two lateral sides of said adjustment slot respectively, such that said first rack and said second rack are parallel with each other at said lateral sides of said adjustment slot, wherein said first rack is supported at a first horizontal level and said second rack is supported at a second horizontal level;

an engaging element disposed at said adjustment slot; and an adjusting element, extended from said engaging element, being configured to drive said engaging element to selectively engage with one of said first rack and said second rack, so as to lock said shoe head with said shoe insole to prevent a sliding movement of said shoe head from said shoe insole when said adjusting element is engaged with said first rack, and to enable said shoe head being free to slide from said shoe insole to selectively adjust a length of said shoe when said adjusting element is engaged with said second rack.

2. The size-adjustable shoe, as recited in claim 1, wherein said engaging element is a gear and each of said first rack and second rack is a gear rack, wherein said adjusting element is a gear shaft extended from said gear for driving said gear to selectively engage with one of said first gear rack and said second gear rack.

3. The size-adjustable shoe, as recited in claim 1, wherein said adjusting telescopic device further comprises a handle for moving said engaging element via said adjusting element, wherein one end of said adjusting element is coupled at said engaging element while an opposed end of said adjusting element is pivotally coupled at said handle, wherein said handle is configured to be folded perpendicularly along an axis direction of said adjusting element to engage said engaging element with said first rack, wherein said handle is also able to be folded to coincide along the axis direction of said adjusting element to engage with said second rack.

4. The size-adjustable shoe, as recited in claim 2, wherein said adjusting telescopic device further comprises a handle for moving said gear via said gear shaft, wherein one end of said gear shaft is coupled at said gear while an opposed end of said gear shaft is pivotally coupled at said handle, wherein said handle is configured to be folded to perpendicularly along an axis direction of said gear shaft until said gear meshes with said first gear rack, and that when said handle is folded to coincide along the axis direction of said gear shaft, said gear meshes with said second gear rack.

5. The size-adjustable shoe, as recited in claim 4, wherein said adjusting telescopic device further comprises an elastic device sheathed on said gear shaft between said gear and said handle, and a sleeve sheathed outside said gear shaft.

6. The size-adjustable shoe, as recited in claim 4, wherein said handle has a positioning slot and said shoe insole further has two or more positioning members spacedly formed at a bottom of said shoe insole, wherein said handle is able to be folded flat on said bottom of said shoe insole to selectively engage said positioning slot with one of said positioning members so as to lock up said shoe head with said shoe insole.

7. The size-adjustable shoe, as recited in claim 5, wherein said handle has a positioning slot and said shoe insole further has two or more positioning members spacedly formed at a bottom of said shoe insole, wherein said handle is folded flat on said bottom of said shoe insole to selectively engage said positioning slot with one of said positioning members so as to lock up said shoe head with said shoe insole.

8. The size-adjustable shoe, as recited in claim 1, wherein said shoe insole has a guiding channel formed therein and said shoe head further comprises a sliding guider protruded therefrom and slidably engaged with said guiding channel to guide a sliding movement of said shoe head from said shoe insole.

9. The size-adjustable shoe, as recited in claim 2, wherein said shoe insole has a guiding channel formed therein and said shoe head further comprises a sliding guider protruded therefrom and slidably engaged with said guiding channel to guide a sliding movement of said shoe head from said shoe insole.

10. The size-adjustable shoe, as recited in claim 5, wherein said shoe insole has a guiding channel formed therein and said shoe head further comprises a sliding guider protruded therefrom and slidably engaged with said guiding channel to guide a sliding movement of said shoe head from said shoe insole.

11. The size-adjustable shoe, as recited in claim 7, wherein said shoe insole has a guiding channel formed therein and said shoe head further comprises a sliding guider protruded therefrom and slidably engaged with said guiding channel to guide a sliding movement of said shoe head from said shoe insole.

12. The size-adjustable shoe, as recited in claim 8, wherein said shoe head further has at least an elongated retention slot formed therein and said shoe insole further comprises at least a retention member extended therefrom, wherein said retention member has an enlarged head portion slidably engaged with said retention slot to prevent said shoe head slidably detached from said shoe insole.

13. The size-adjustable shoe, as recited in claim 9, wherein said shoe head further has at least an elongated retention slot formed therein and said shoe insole further comprises at least a retention member extended therefrom, wherein said retention member has an enlarged head portion slidably engaged with said retention slot to prevent said shoe head slidably detached from said shoe insole.

14. The size-adjustable shoe, as recited in claim 10, wherein said shoe head further has at least an elongated retention slot formed therein and said shoe insole further comprises at least a retention member extended therefrom, wherein said retention member has an enlarged head portion slidably engaged with said retention slot to prevent said shoe head slidably detached from said shoe insole.

15. The size-adjustable shoe, as recited in claim 11, wherein said shoe head further has at least an elongated retention slot formed therein and said shoe insole further comprises at least a retention member extended therefrom, wherein said retention member has an enlarged head portion slidably engaged with said retention slot to prevent said shoe head slidably detached from said shoe insole.

16. The size-adjustable shoe, as recited in claim 1, further comprising a retention panel, which is made of rigid material, embedded into said shoe head, wherein said adjustment slot is formed at said retention panel.

17. The size-adjustable shoe, as recited in claim 2, further comprising a retention panel, which is made of rigid material, embedded into said shoe head, wherein said adjustment slot is formed at said retention panel.

18. The size-adjustable shoe, as recited in claim 7, further comprising a retention panel, which is made of rigid material, embedded into said shoe head, wherein said adjustment slot is formed at said retention panel.

19. The size-adjustable shoe, as recited in claim 11, further comprising a retention panel, which is made of rigid material, embedded into said shoe head, wherein said adjustment slot is formed at said retention panel.

20. The size-adjustable shoe, as recited in claim 15, further comprising a retention panel, which is made of rigid material, embedded into said shoe head, wherein said adjustment slot is formed at said retention panel.

* * * * *